US007061182B2

(12) United States Patent
Higashi et al.

(10) Patent No.: US 7,061,182 B2
(45) Date of Patent: Jun. 13, 2006

(54) METAL HALIDE LAMP

(75) Inventors: Masanori Higashi, Osaka (JP); Yoshiharu Nishiura, Shiga (JP); Shigefumi Oda, Osaka (JP); Hiroshi Enami, Hyogo (JP); Shunsuke Kakisaka, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 218 days.

(21) Appl. No.: 10/185,930

(22) Filed: Jun. 27, 2002

(65) Prior Publication Data

US 2003/0020408 A1 Jan. 30, 2003

(30) Foreign Application Priority Data

Jun. 27, 2001 (JP) ..... 2001-195302

(51) Int. Cl.
*H01J 17/20* (2006.01)

(52) U.S. Cl. ..... 313/637

(58) Field of Classification Search ..... 313/636–641, 313/25, 573
See application file for complete search history.

(56) References Cited

U.S. PATENT DOCUMENTS

| | | | | |
|---|---|---|---|---|
| 3,786,297 | A * | 1/1974 | Zollweg et al. | 313/640 |
| 3,798,487 | A | 3/1974 | Zollweg et al. | |
| 4,024,425 | A | 5/1977 | Higashi et al. | |
| 4,081,846 | A * | 3/1978 | Roscamp et al. | 313/641 |
| 4,422,011 | A * | 12/1983 | Bruninx-Poesen et al. | 313/642 |
| 4,634,927 | A | 1/1987 | Mori et al. | |
| 4,810,938 | A * | 3/1989 | Johnson et al. | 315/248 |
| 4,914,345 | A * | 4/1990 | Suster et al. | 313/318.01 |
| 4,972,119 | A * | 11/1990 | Kariya et al. | 313/624 |
| 4,972,120 | A * | 11/1990 | Witting | 313/638 |
| 4,978,884 | A * | 12/1990 | Van Vliet et al. | 313/25 |
| 5,013,968 | A * | 5/1991 | Russell et al. | 313/641 |
| 5,239,232 | A * | 8/1993 | Heider et al. | 313/639 |
| 5,464,462 | A * | 11/1995 | Langer et al. | 65/66 |
| 5,773,932 | A * | 6/1998 | Ooyama et al. | 313/639 |
| 5,905,341 | A * | 5/1999 | Ikeuchi et al. | 313/639 |
| 5,936,351 | A | 8/1999 | Lang | |
| 5,973,453 | A * | 10/1999 | Van Vliet et al. | 313/623 |
| 5,973,454 | A * | 10/1999 | Ooyama et al. | 313/639 |
| 6,005,346 | A * | 12/1999 | Shaffner | 313/637 |
| 6,054,810 | A * | 4/2000 | Yamamoto et al. | 313/607 |

(Continued)

FOREIGN PATENT DOCUMENTS

| | | |
|---|---|---|
| CN | 1099112 | 2/1995 |

(Continued)

*Primary Examiner*—Joseph Williams
*Assistant Examiner*—Dalei Dong
(74) *Attorney, Agent, or Firm*—Hamre, Schumann, Mueller & Larson, P.C.

(57) ABSTRACT

A metal halide lamp has an arc tube including an arc tube container made of an oxide-based translucent ceramic material. The arc tube is filled with cerium halide as a luminescent material and a halide of a rare earth element that is more reactive with the ceramic material than is the cerium halide. Accordingly, a reaction between the oxide-based translucent ceramic material and the halide of a rare earth element is accelerated while a reaction between the oxide-based translucent ceramic material and the cerium halide is suppressed. This suppresses a decrease of the cerium halide that serves for light emission, and also reduces changes in the lamp color temperature. Thereby, during aging of the lamp, the flux maintenance factor and color temperature are improved. Therefore, the indoor-outdoor metal halide lamp provides a white light source color that has high-wattage, high luminous efficiency, and a long service life.

12 Claims, 6 Drawing Sheets

U.S. PATENT DOCUMENTS

| | | | | |
|---|---|---|---|---|
| 6,069,456 | A | 5/2000 | Fromm et al. | |
| 6,118,216 | A * | 9/2000 | Marlor | 313/636 |
| 6,194,832 | B1 | 2/2001 | Juengst | |
| 6,218,781 | B1 * | 4/2001 | Genz et al. | 313/637 |
| 6,222,320 | B1 | 4/2001 | Stockwald | |
| 6,501,220 | B1 | 12/2002 | Lambrechts et al. | |
| 6,707,252 | B1 * | 3/2004 | Kakisaka et al. | 313/623 |
| 6,756,721 | B1 * | 6/2004 | Higashi et al. | 313/17 |

FOREIGN PATENT DOCUMENTS

| | | |
|---|---|---|
| CN | 1204857 | 1/1999 |
| EP | 0 049 545 | 4/1982 |
| EP | 0 453 893 | 10/1991 |
| EP | 0 720 209 | 7/1996 |
| EP | 0 905 744 | 3/1999 |
| EP | 1 271 614 | 1/2003 |
| JP | 51-124077 | 10/1976 |
| JP | 54-102070 | 8/1979 |
| JP | 57-92747 | 6/1982 |
| JP | 8-36994 | 2/1996 |
| JP | 10-144761 | 5/1998 |
| JP | 2000-501363 | 2/2000 |
| WO | WO 98/25294 | 6/1998 |
| WO | 00/45419 | 8/2000 |
| WO | 01/43163 | 6/2001 |

* cited by examiner

METAL HALIDE LAMP

FIELD OF THE INVENTION

The present invention relates to an arc tube used for a metal halide lamp.

BACKGROUND OF THE INVENTION

Metal halide lamps using ceramic arc tubes have been used widely for indoor lighting in stores and shops because such metal halide lamps have higher luminous efficiency, higher color rendering and longer service lives when compared to metal halide lamps using quartz arc tubes.

FIGS. 5 and 6 show respectively a metal halide lamp using a conventional ceramic arc tube. An arc tube 28 comprises an arc tube container 29 composed of a discharge arc tube portion 30 of a polycrystalline alumina ceramic material and a pair of thin tube portions (31, 32) sintered at the both ends of the discharge arc tube portion 30. A pair of tungsten coil electrodes (33, 34) are arranged at the both ends of the arc tube 28. Feeding portions (35, 36) of niobium or conductive cermet are adhered hermetically to the thin tube portions (31, 32) by means of frit 37, and the tungsten electrodes (33, 34) are connected to the respective feeding portions (35, 36). A luminescent material 38 comprising a metal halide, mercury as a buffer gas, and a start-aiding rare gas such as argon are filled in the arc tube 28. As illustrated in FIG. 6, the arc tube 28 composing a lamp 39 is disposed inside an outer bulb 40 of either quartz or hard glass, and a base 41 is attached to the outer bulb 40. About 50 kPa of a nitrogen-based gas is filled in the outer bulb 40. In general, the lamp 39 is turned on by means of a copper-iron inductance ballast or an electron ballast with a built-in starter.

For example, references such as JP-57(1982)-92747 A and U.S. Pat. No. 5,973,453 describe the use of cerium iodide in combination with sodium iodide for a luminescent material applicable for a typical metal halide lamp for indoor/outdoor use. The luminescent material of cerium iodide can provide improved luminous efficiency since many of the emission spectra of cerium are distributed in a region with a higher relative luminosity factor regarding human eyes. U.S. Pat. No 5,973,453 and Tokuhyo-2000-501563 (published Japanese translation of PCT international publication for patent application) describe a suitable NaI/$CeI_3$ molar composition ratio in a range from 3 to 25 (corresponding to a $CeI_3$ composition ratio from 12.2 wt % to 53.7 wt %), which is suitable for obtaining white light source color.

However, a conventional metal halide lamp filled with a luminescent material of cerium iodide and sodium iodide has a problem of a drastic change in the lamp color temperature as well as a remarkable lowering in the flux maintenance factor over the lighting time.

SUMMARY OF THE INVENTION

The above-described problems occur since the filled cerium halide reacts with the ceramic material, resulting in a drastic reduction of cerium halide that serves for light emission.

For preventing the problems, a metal halide lamp according to the present invention comprises an arc tube having an envelope as an arc tube container made of an oxide-based translucent ceramic material, and the arc tube is filled with a cerium halide as a luminescent material and a halide of a rare earth element that is more reactive with the ceramic material than is the cerium halide.

DETAILED DESCRIPTION OF THE INVENTION

A metal halide lamp arc tube according to the present invention can be identical to that of a conventional technique, or a conventional metal halide lamp arc tube can be applied to the present invention. The present invention provides a material that is more reactive with a ceramic material than is a cerium halide in order to maintain a high flux maintenance factor while preventing a drastic change in the lamp color temperature.

In the metal halide lamp, it is preferable that a halide of a rare earth element is at least one selected from the group consisting of scandium halide, gadolinium halide, terbium halide, dysprosium halide, holmium halide, erbium halide, thulium halide, ytterbium halide, lutetium halide, samarium halide, yttrium halide, and europium halide. A preferred halogen is either bromine (Br) or iodine (I). Among the above-described halides of rare earth elements, scandium halide ($ScI_3$) is particularly preferred.

It is also preferable that a filling amount of a halide of a rare earth element is in a range from 1.5 molar parts to 100 molar parts when a filling amount of the cerium halide is 100 molar parts. Accordingly, the oxide-based translucent ceramic material will react preferentially with a halide of a rare earth element other than cerium halide, and thus a reaction between the oxide-based translucent ceramic material and the cerium halide can be suppressed. This can suppress the decrease of cerium halide that serves for light emission, and also reduce changes in the lamp color temperature.

It is also preferable that thallium halide and indium halide also are filled in the arc tube.

It is preferable that a filling amount of the thallium halide is in a range from 1.0 wt % to 7.0 wt % with respect to the whole amount of the metal halide, and a ratio in the filling amount of the thallium halide to the indium halide is in a range of $0.6 \leqq TlX\ wt\ \% / InX\ wt\ \% \leqq 4.0$ (X=halogen). Accordingly, the arc discharge can be spread to suppress a local rise in the temperature of the arc tube. As a result, a reaction between the halide and the oxide-based translucent ceramic material can be suppressed, and thus the service life of the lamp can be prolonged.

It is preferable that the metal halide lamp according to the present invention has a rated service life of at least 12000 hrs and a lamp efficiency of at least 117 lm/W in its initial state. Here, 'initial state' denotes a condition at an aging time of 100 hrs. As mentioned above, the present invention provides a metal halide lamp that can prevent lowering of flux maintenance factor and color temperature, and the metal halide lamp can be applied for general indoor and outdoor use. The metal halide lamp emitting white light is a high-wattage and long-life type, and it has high luminous efficiency, higher light color temperature and a higher general color rendering index.

Embodiments of the present invention will be described below by referring to FIGS. 1 and 2.

Figure 1:
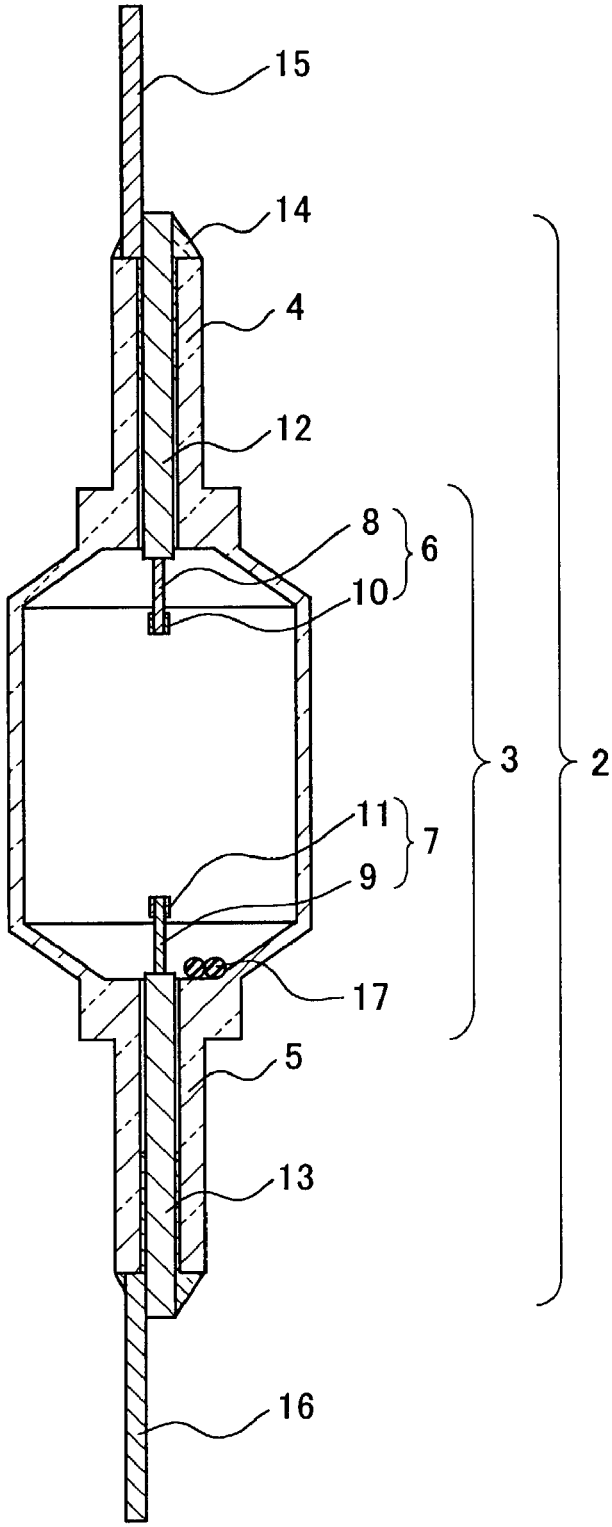
FIG. 1 shows a structure of an arc tube of a metal halide lamp in one embodiment of the present invention.
Figure 2:
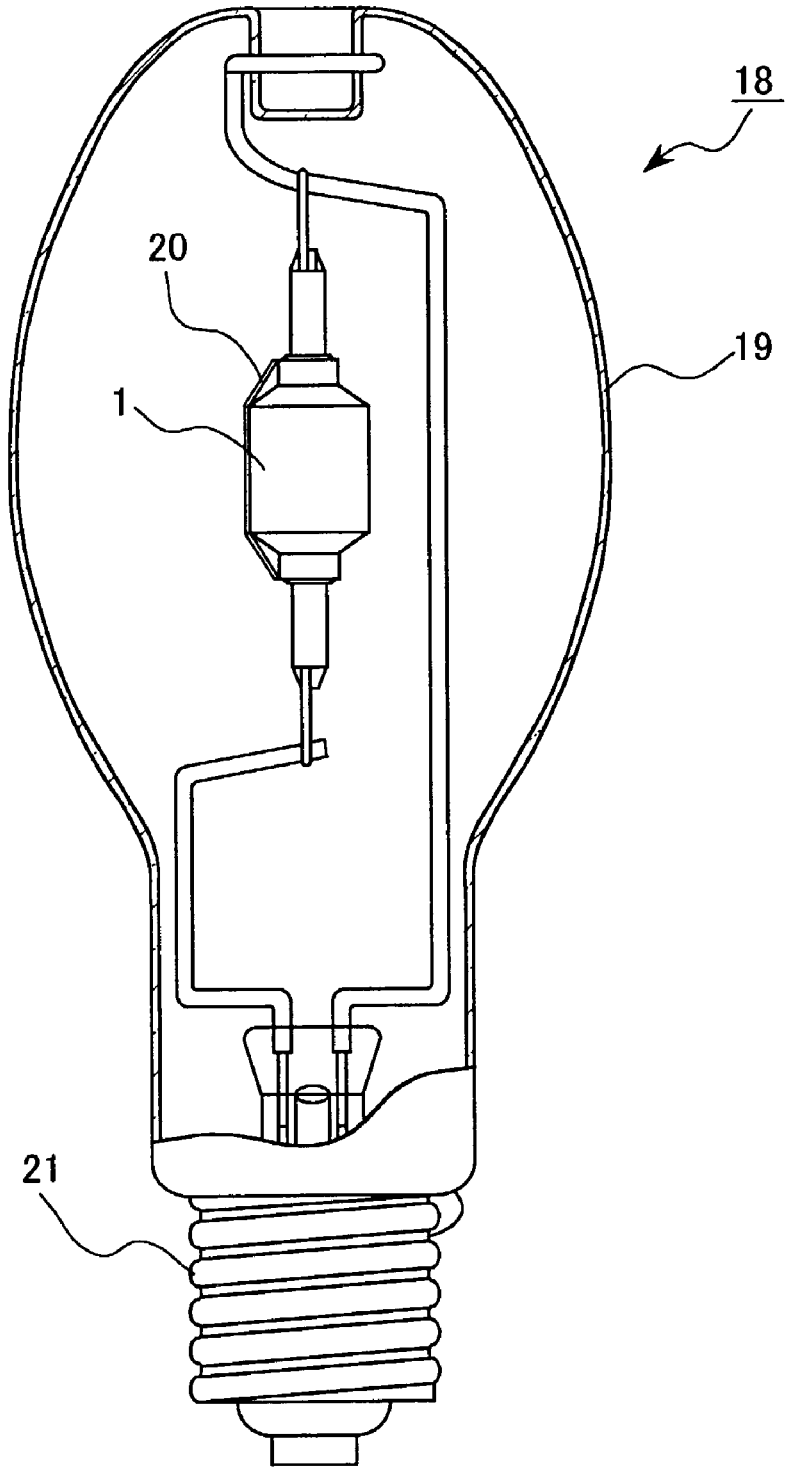
FIG. 2 is a general view of a metal halide lamp in one embodiment of the present invention.

FIGS. 1 and 2 respectively show structures of an arc tube of a metal halide lamp having an alumina ceramic tube with 200 W. and an entire lamp including the arc tube.

An arc tube 1 comprises an arc tube container 2 composed of a discharge arc tube portion 3 made of a polycrystalline alumina ceramic and a pair of thin tubes (4,5) sintered at the both ends of the discharge arc tube portion 3. The arc tube container 2 is not limited to the polycrystalline alumina ceramic but any oxide-based translucent ceramics can be used similarly. For example, $Al_2O_3$ (alumina), $Y_3Al_5O_3$ (YAG), BeO, MgO, $Y_2O_3$, $Yb_2O_3$, and $ZrO_2$can be used.

A pair of tungsten coil electrodes (6,7) are formed at the both ends of the arc tube 1, and the respective tungsten coil electrodes (6,7) comprise tungsten electrode rods (8,9) and tungsten coils (10,11). The electrodes are arranged with a distance of 18.0 mm. Feeding portions (12,13) of a conductive cermet are adhered hermetically to the thin tube portions (4,5) by means of frit 14. Each of the tungsten rods (8,9) is welded to one end of each of the feeding portions (12,13), while niobium outer leads (15,16) are welded to the other ends of the feeding portions (12,13) respectively. A cerium halide-based luminescent material 17, mercury as a buffer gas and a start-aiding rare gas containing an argon gas are filled in the arc tube 1.

FIG. 2 is a general view of a lamp 18 comprising the arc tube 1. The arc tube 1 is arranged in the interior of an outer bulb 19 made of hard glass. For further lowering the lamp starting voltage, a start-aiding conductor 20 made of a molybdenum wire is attached along the discharge arc tube portion 3 of the arc tube container 2. An inert gas such as a 50 kP of a nitrogen gas is filled in the outer bulb 19. The interior of the outer bulb can be evacuated. Numeral 21 denotes a base.

EXAMPLE 1

Figure 3:
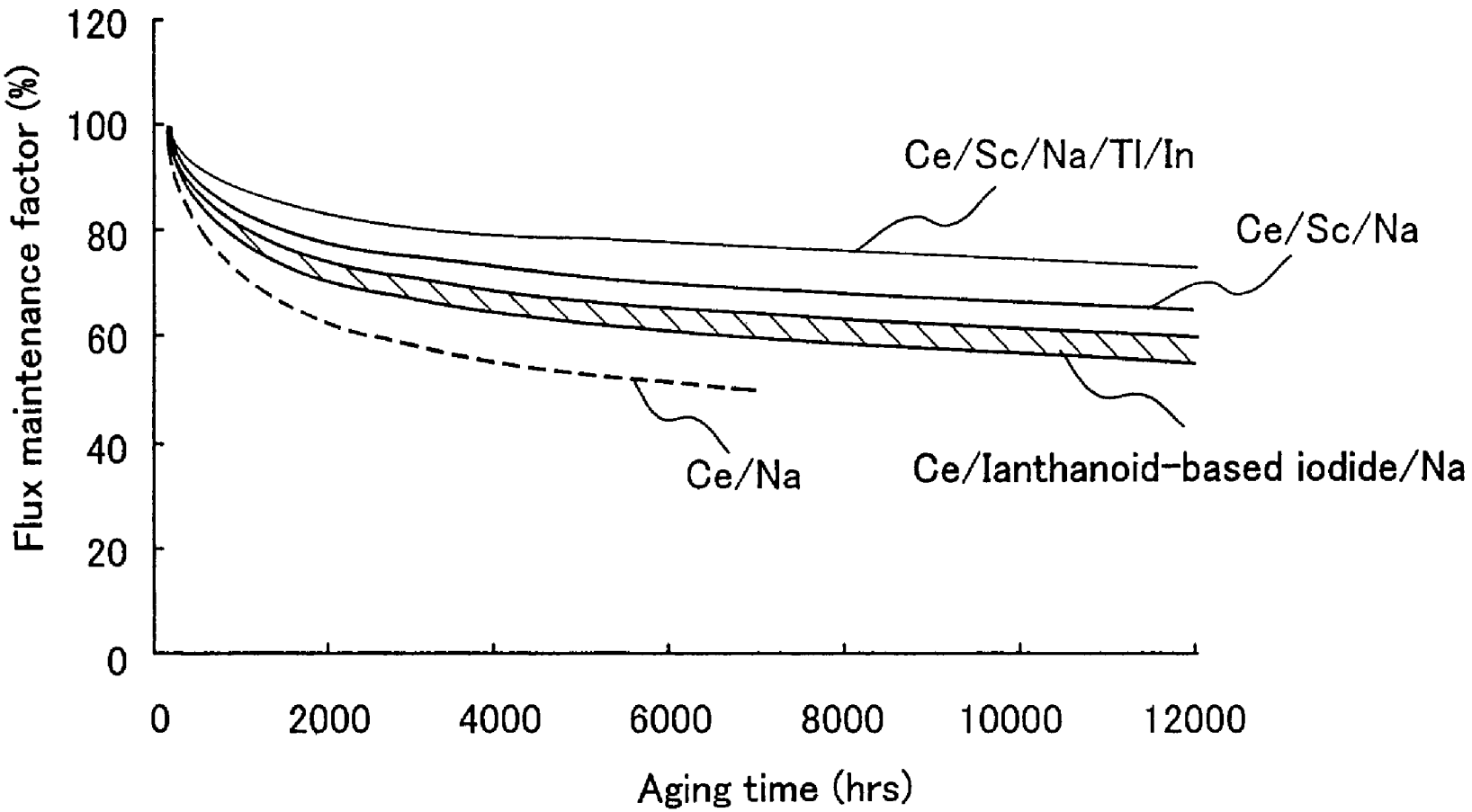
FIG. 3 is a graph showing a flux maintenance factor in aging for metal halide lamps according to Examples 1–3 of the present invention.

For examining the service life in aging, a lamp 18 comprising an arc tube 1 was prepared. The arc tube 1 was previously filled with 6 mg of a luminescent material 17 composed of 35 wt % (14 mol %) of $CeI_3$, 60 wt % (83.5 mol %) of NaI, and 5 wt % (2.5 mol %) of $ScI_3$. As shown in FIG. 3 as a line of Ce/Sc/Na, the flux maintenance factor of the lamp was improved drastically to 65% when the aging time was about 12000 hrs. The color temperature change during the aging was not more than −150 K, and this was better in comparison with a lamp that was not filled with $ScI_3$.

In an analysis of the lamp after an aging of 5000 hrs, a sufficient amount of $CeI_3$ remained (80–90% of the initial filling amount). To the contrary, only 20–30% of $ScI_3$ remained since relatively a large amount of $ScI_3$ reacted with the alumina ceramic.

Among the initial properties of the lamp 18, the flux and the luminous efficiency were 22800 lm and 117 lm/W respectively i.e., initial values thereof were kept substantially, while the light color temperature and the general color rendering index Ra were improved. That is, the light color temperature was as high as 4300 K at an initial stage, and the general color rendering index Ra exceeded a desired value of 65 and reached 70. The light source color also was improved.

COMPARATIVE EXAMPLE 1

A lamp 18 comprising a conventional arc tube 1 was prepared. The lamp 18 was filled with 6 mg of a luminescent material 17 composed of cerium-sodium iodides (36 wt % (13.9 mol %) of $CeI_3$+64 wt % (86.1 mol %) of NaI). This NaI/$CeI_3$ composition ratio according to the conventional technique provides a white light source color in a range from about 3500 K to about 4000 K, First, the initial properties of the lamp were measured at an aging time of 100 hrs. For a white light source color having a color temperature of 4100 K the lamp flux was 23600 lm and the luminous efficiency was 118 lm/W (both are average values of four lamps). Namely, a desired value (117 ml/W) of luminous efficiency was obtained barely, though the general color rendering index was 60, i.e., lower than the desired value of 65.

Next, a lamp aging test was carried out for measuring the flux maintenance factor. As illustrated by the line of Ce/Na in FIG. 3, the flux maintenance factor dropped to 50% within the aging time of about 6800 hrs. Generally, a lifetime of a metal halide lamp is defined by an aging time at which a flux maintenance factor drops to 50%. The lamp light color was lowered gradually from the initial value of 4100 K to 3700 K during the service life of 5000 hrs .

An analysis of the alumina ceramic arc tube after the aging showed that the inner wall of the arc tube was corroded by a reaction with the cerium, and the corrosion was relatively remarkable at the upper part of the arc tube. After the aging time of 5000 hrs, a large amount (90% of the initial amount) of NaI remained in the tube while $CeI_3$ was decreased drastically, i.e., 40–60% of its initial filling amount.

As described above, both the flux maintenance factor and the light color of the lamp 18 filled with ($CeI_3$+NaI) dropped drastically. This is caused by a combination of two phenomena. First, cerium iodide in the tube reacts with the alumina ceramic ($Al_2O_3$) of the arc tube and decreases. Secondly, since the discharge arc is focused and bent towards the arc tube wall, the temperature of the arc tube is raised locally to accelerate the reaction between the cerium iodide and the alumina ceramic. In other words, a ratio of $CeI_3$ that presents high luminous efficiency and high color temperature was decreased faster than NaI during the service life, and thus the flux and the light color were lowered.

An analysis of the Example 1 and Comparative Example shows that a basic measure for suppressing a reaction of cerium during a service life of the lamp is effective. That is, a lanthanoid-based metal halide is added to the interior of the arc tube so that the lanthanoid-based metal halide will react with the inner wall of the tube in an initial stage of lamp aging. This lanthanoid-based metal halide is required to have a smaller standard Gibbs energy in formation of an oxide than that of the cerium halide, so that the lanthanoid-based metal halide can react with alumina easily. Examples of effective lanthanoid-based metal halides include scandium iodide ($ScI_3$), gadolinium iodide ($GdI_3$), terbium iodide ($TbI_3$), dysprosium iodide ($DyI_3$), holmium iodide ($HoI_3$), erbium iodide ($ErI_3$), thulium iodide ($TmI_3$), ytterbium iodide ($YbI_3$), lutetium iodide ($LuI_3$), samarium iodide ($SmI_3$) (diatomic Sm), and europium iodide ($EuI_3$) (diatomic Eu). Scandium iodide is most favorable among these iodides.

EXAMPLE 2

A lamp was prepared under the same condition of Example 1 except that the filling amount of scandium iodide was varied in a range from 0 to 200 molar parts with respect to 100 molar parts of $CeI_3$, and the lamp was subjected to an aging test. When the amount of the scandium iodide exceeded 100 molar parts, the tungsten electrodes (6,7) were deformed and worn and also the arc tube was blackened, and this caused lowering of the flux maintenance factor. When the amount of the scandium iodide was less than 1.5 molar parts, no specific effects were expressed in suppressing a reaction between alumina and cerium halide.

The test results show that a preferred range of the amount of scandium iodide is from 1.5 molar parts to 100 molar parts when $CeI_3$ is 100 molar parts. In an analysis after the aging, a small amount of aluminum was detected in the tube of a lamp in which at least 150 molar parts of $ScI_3$ had been filled. The aluminum is derived from aluminum iodide ($AlI_3$), which was formed by a reaction between scandium iodide and the alumina ceramic $Al_2O_3$. A reaction formula is as follows.

$$2ScI_3+Al_2O_3 \leftrightarrows Sc_2O_3+2AlI_3 \quad \text{(Formula 1)}$$

The aluminum iodide is considered to cause the above-described wear of electrode and blackening of the arc tube.

As described above, a metal halide lamp comprising an alumina ceramic tube can provide a rated service life of at least 12000 hrs and luminous efficiency of at least 117 lm/W, when 1.5–100 molar parts of scandium iodide (0.5–20 molar parts relative to the entire filling) with respect to 100 molar parts of $CeI_3$ in an alumina ceramic tube in which a luminescent material of cerium iodide and sodium iodide are filled. The light color and general color rendering index are also improved. Such a lamp can provide a high wattage, high luminous efficiency and a long service life in indoor and outdoor use.

Similar lamps were prepared for examining the service life in aging, to which 2 to 200 molar parts of metal iodide other than scandium iodide was added. Examples of the metal iodide were gadolinium iodide ($GdI_3$), terbium iodide ($TbI_3$), dysprosium iodide ($DyI_3$), holmium iodide ($HoI_3$), erbium iodide ($ErI_3$), thulium iodide ($TmI_3$), ytterbium iodide ($YbI_3$), lutetium iodide ($LuI_3$), samarium iodide ($SmI_3$) (diatomic Sm), and europium iodide ($EuI_3$) (diatomic Eu). The result is shown as a line of Ce/lanthanoid-based iodide/Na in FIG. 3. As clearly shown in FIG. 3, the initial luminous efficiency and the general color rendering index Ra substantially reached their desired levels.

The service life was improved as much as the case using scandium iodide, though the flux maintenance factor at an aging time of 12000 hrs was inferior to that of a lamp using scandium iodide.

EXAMPLE 3

Example 3 addresses a method for improving a flux maintenance index by suppressing the focusing or bending of an arc discharge caused especially by the above-mentioned cerium halide luminescent material, and also for obtaining another essential object of improving the luminous efficiency. It was most effective when a combination of thallium halide (TlX) and indium halide InX was filled to serve as an additional luminescent material.

Specifically, a lamp 18 used for measurement of the initial properties and the change in the flux maintenance index in aging was prepared by adding TlI and InI in a composition range from 0 to 10 wt % to the above-described luminescent material ($CeI_3$+NaI+$ScI_3$).

It was observed that the arc discharge was spread and its bending towards the arc tube wall was suppressed when more TlI and InI were filled. The flux maintenance factor of the lamp 18 in aging was further improved, and a rated service life was improved, i.e., the flux maintenance factor was at least 60% at a time of 12000 hrs. The reason is as follows. Since the average excitation voltage Ve of thallium and indium is higher than ionization potential Vi (Ve>0.585 Vi), the arc discharge was spread effectively, so that the local rise in temperature on the tube wall was suppressed. Relatively small amounts of TlI and InI (the total amount was 3.0 wt % or more) served to spread the arc discharge relatively remarkably, and the service life was as long as 12000 hrs.

With regard to improvement of the initial luminous efficiency, filling of thallium iodide was effective particularly, since thallium iodide radiates 546 mn green light having a high relative luminosity factor. Since the TlI may shift the lamp luminescent color to a green side, indium iodide (InI) radiating 450 nm blue light is filled for the correction. That is, a filling amount of TlI should be in a proper range for preventing the luminescent color to be shifted to the green side, and the composition ratio of TlI to InI should be selected properly in order to provide a white light source color that can be used for general indoor and outdoor lighting. It was found that when $1.0 \leqq$ TlI wt % $\leqq 7.0$ and also $0.6 \leqq$ TlI wt %/InI wt % $\leqq 4.0$, the luminescent efficiency exceeds the desired value of 117 lm/W and the obtained white light source color can be applied generally for indoor/outdoor use.

Figure 4:
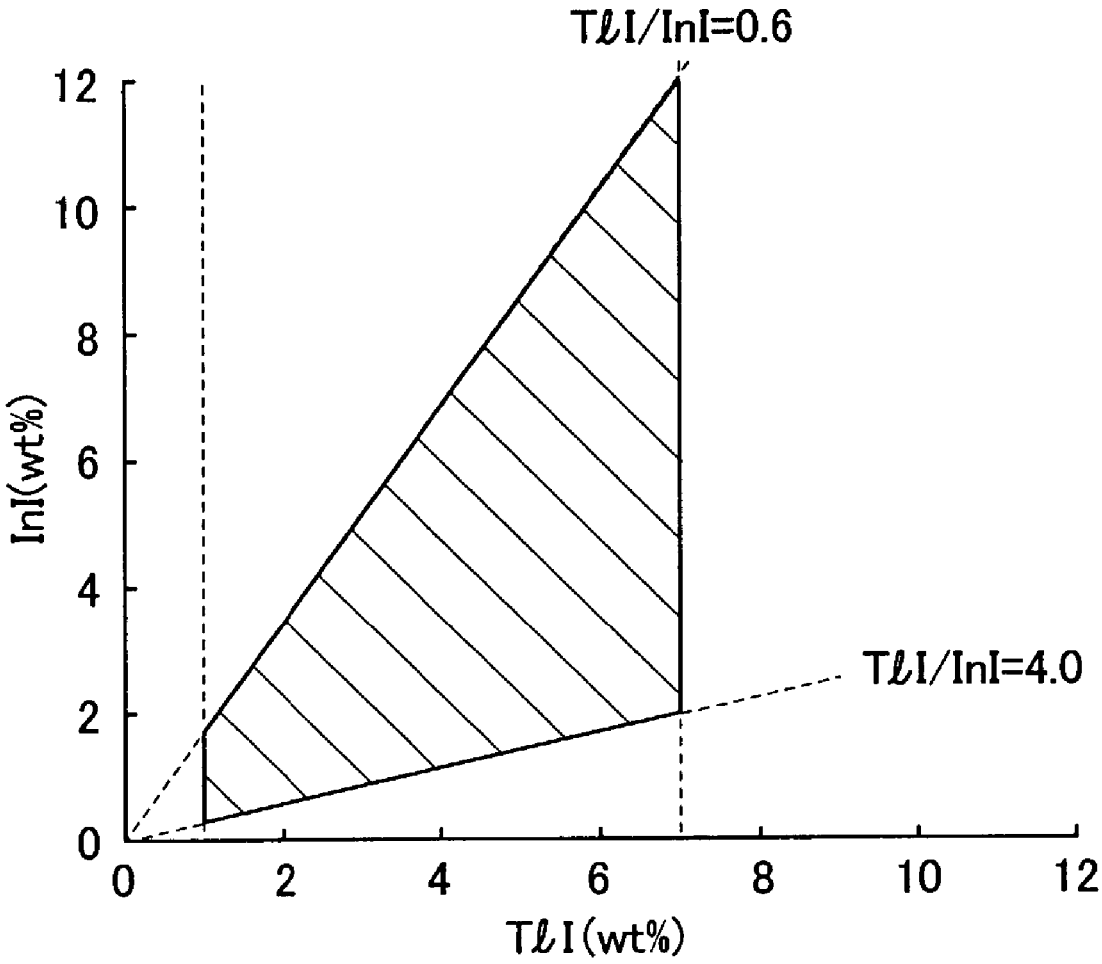
FIG. 4 is a graph showing a preferred composition range in Example 3 of the present invention.
Figure 5:
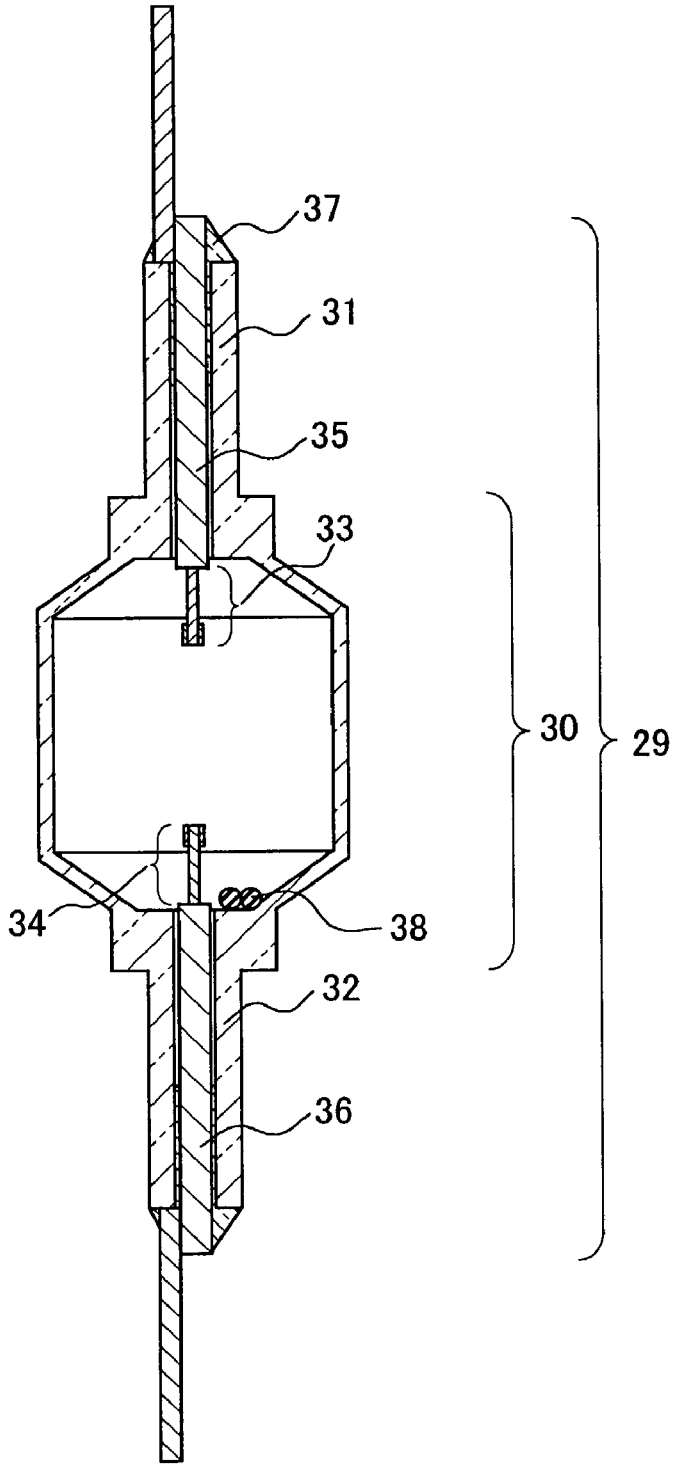
FIG.5 PRIOR ART
FIG. 5 shows a structure of an arc tube of a conventional metal halide lamp.
Figure 6:
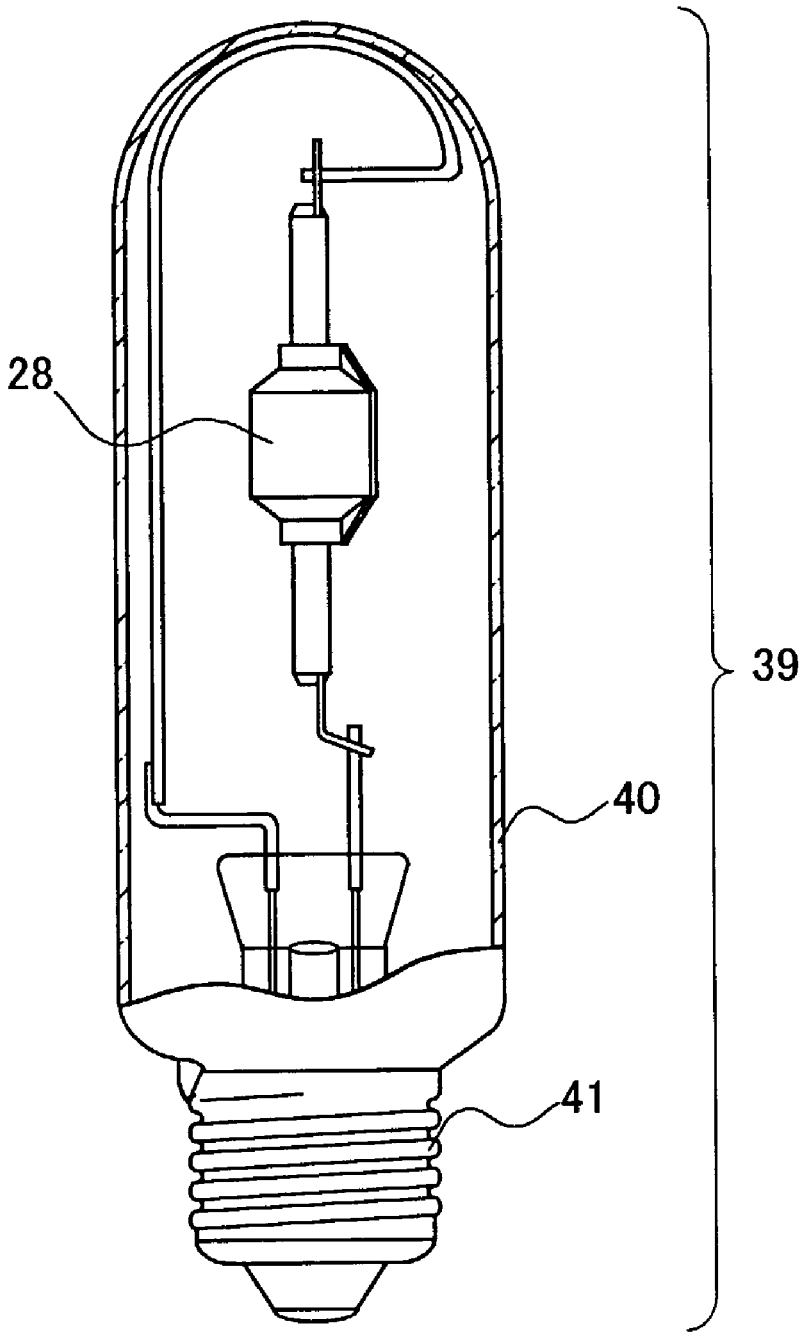
FIG.6 PRIOR ART
FIG. 6 is a general view of a conventional metal halide lamp.

FIG. 4 illustrates a preferred range of compositions of Example 3.

Atypical luminescent material 17 of the present invention contained 34 wt % (14.1 mol %) of $CeI_3$+55 wt % (79.0 mol %) of NaI+5 wt % (2.5 mol %) of $ScI_3$+3.5 wt % (2.3 mol %) of TlI+2.5 wt % (2.1 mol %) of InI. This luminescent material 17 was filled in a 200 W type lamp 18. The lamp 18 showed excellent performance in indoor and outdoor use, i.e., for the initial properties, the flux was about 24100 lm and the luminous efficiency was 123.3 lm/W when a white light source color having a color temperature of 4340 K was used (all of the properties were taken as average values of four lamps). On the other hand, it is also indicated by the line of Ce/Sc/Na/Tl/In in FIG. 3 that the flux maintenance index in aging was kept as high as 73% even at a point of 12000 hrs. While a conventional quartz arc tube lamp has a rated service life of 9000 hrs, the lamp of the present invention has a rated service life of 12000 hrs. Moreover, the general color rendering index Ra was improved and it reached 75 while the desired value was 65.

Similar lamps were prepared for examining the service life properties in aging, to which metal iodides other than scandium iodide were added. Examples of the metal iodides were gadolinium iodide ($GdI_3$), terbium iodide ($TbI_3$), dysprosium iodide ($DyI_3$), holmium iodide ($HoI_3$), erbium iodide ($ErI_3$), thulium iodide ($TmI_3$), ytterbium iodide ($YbI_3$), lutetium iodide ($LuI_3$), samarium iodide ($SmI_3$) (diatomic Sm), and europium iodide ($EuI_3$) (diatomic Eu), to which TlI and InI were added further. The flux maintenance indices of the lamps were improved further, and the rated service lives were extended to 12000 hrs or more. Desired values were obtained in the luminous efficiency and the general color rendering indices Ra.

Accordingly, a metal halide lamp comprises an alumina ceramic tube filled with cerium iodide as a main luminescent material, and a lanthanoid-based metal iodide. It is most preferable that the lanthanoid-based metal iodide is scandium iodide in an amount defined in a range from 1.5 molar parts to 100 molar parts (0.5–20 molar % in the entire metal halides) when the cerium iodide was 100 molar parts. Furthermore, thallium iodide and indium iodide are filled in a composition range 1.0≦TlI wt %≦7.0 and also 0.6≦TlI wt %/InI wt %≦4.0, so that the lamp flux maintenance index can be improved further and the luminous efficiency is also improved. As a result, both the rated service life and the luminous efficiency exceed easily the respective desired values of 12000 hrs and 117 lm/W. A thus obtained alumina ceramic tube high-pressure discharge lamp for indoor and outdoor use is a high-wattage type and it has high luminous efficiency and a long service life.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, all changes that come within the meaning and range of equivalency of the claims are intended to be embraced therein.

The invention claimed is:

1. A metal halide lamp comprising an arc tube having an arc tube container as an envelope that is made of oxide-based translucent ceramic material and comprises a discharge arc tube portion, the arc tube being filled with sodium iodide, cerium halide as a luminescent material, and a halide of a rare earth element that is more reactive with the ceramic material than is the cerium halide, wherein a filling amount of the halide of a rare earth element is in a range from 1.5 molar parts to 100 molar parts when a filling amount of the cerium halide is 100 molar parts and wherein the oxide-based translucent ceramic material is at least one ceramic selected from the group consisting of polycrystalline alumina ceramic, $Al_2O_3$ (alumina), $Y_3Al_5O_3$, BeO, MgO, $Y_2O_3$, $Yb_2O_3$, and $ZrO_2$.

2. The metal halide lamp according to claim 1, wherein the halide of the rare earth element is at least one selected from the group consisting of scandium halide, gadolinium halide, terbium halide, dysprosium halide, holmium halide, erbium halide, thulium halide, ytterbium halide, lutetium halide, samarium halide, yttrium halide, and europium halide.

3. The metal halide lamp according to claim 1, wherein thallium halide and indium halide are filled in the arc tube.

4. The metal halide lamp according to claim 3, wherein an amount of the thallium halide is in a range from 1.0 wt % to 7.0 wt % with respect to the entire metal halides, and a ratio in the amount of the thallium halide to the filled indium halide is in a range of 0.6≦ TlX wt %/InX wt %≦4.0, where X denotes halogen.

5. The metal halide lamp according to claim 1, wherein the cerium halide and the halide of the rare earth element comprise iodine as a halogen.

6. The metal halide lamp according to claim 1, wherein an outer bulb of hard glass is formed outside the arc tube and filled with an inert gas.

7. The metal halide lamp according to claim 1, wherein a start-aiding conductor is attached along the discharge arc tube portion of the arc tube container, and the start-aiding conductor lowers the lamp starting voltage.

8. A metal halide lamp comprising an arc tube having an arc tube container as an envelope that is made of oxide-based translucent ceramic material and comprises a discharge arc tube portion, the arc tube being filled with cerium halide as a luminescent material and a halide of a rare earth element that is more reactive with the ceramic material than is the cerium halide, wherein a filling amount of the halide of a rare earth element is in a range from 1.5 molar parts to 100 molar parts when a filling amount of the cerium halide is 100 molar parts, wherein the oxide-based translucent ceramic material is at least one ceramic selected from the group consisting of polycrystalline alumina ceramic, $Al_2O_3$ (alumina), $Y_3Al_5O_3$, BeO, MgO, $Y_2O_3$, $Yb_2O_3$, and $ZrO_2$, wherein thallium halide and indium halide are filled in the arc tube, and wherein an amount of the thallium halide is in a range from 1.0 wt % to 7.0 wt % with respect to the entire metal halides, and a ratio in the amount of the thallium halide to the filled indium halide is in a range of 0.6≦TlX wt %/InX wt % ≦ 4.0, where X denotes halogen.

9. The metal halide lamp according to claim 8, wherein the halide of the rare earth element is at least one selected from the group consisting of scandium halide, gadolinium halide, terbium halide, dysprosium halide, holmium halide, erbium halide, thulium halide, ytterbium halide, lutetium halide, samarium halide, yttrium halide, and europium halide.

10. The metal halide lamp according to claim 8, wherein the cerium halide and the halide of the rare earth element comprise iodine as a halogen.

11. The metal halide lamp according to claim 8, wherein an outer bulb of hard glass is formed outside the arc tube and filled with an inert gas.

12. The metal halide lamp according to claim 8, wherein a start-aiding conductor is attached along the discharge arc tube portion of the arc tube container, and the start-aiding conductor lowers the lamp starting voltage.

* * * * *